US007273257B2

(12) United States Patent
De Vroe

(10) Patent No.: US 7,273,257 B2
(45) Date of Patent: Sep. 25, 2007

(54) RECLINER CHAIR HAVING A TURNING UP AND STRETCHING OUT FOOTREST MECHANISM

(75) Inventor: Koen De Vroe, Zottegem (BE)

(73) Assignee: TOMOH GmbH, Würselen (DE)

( * ) Notice: Subject to any disclaimer, the term of this patent is extended or adjusted under 35 U.S.C. 154(b) by 143 days.

(21) Appl. No.: 10/531,046

(22) PCT Filed: Oct. 14, 2003

(86) PCT No.: PCT/BE03/00174

§ 371 (c)(1),
(2), (4) Date: Apr. 12, 2005

(87) PCT Pub. No.: WO2004/034849

PCT Pub. Date: Apr. 29, 2004

(65) Prior Publication Data

US 2006/0103218 A1 May 18, 2006

(30) Foreign Application Priority Data

Oct. 14, 2002 (BE) ..... 2002/0593

(51) Int. Cl.
*A47C 7/50* (2006.01)
*A47C 20/12* (2006.01)
*A47C 20/04* (2006.01)

(52) U.S. Cl. ..... 297/452.26; 297/452.3; 297/452.36; 297/69; 297/84; 297/330

(58) Field of Classification Search ..... 297/423.24, 297/423.28, 423.3, 423.34, 423.35, 423.36, 297/69, 70, 84, 330
See application file for complete search history.

(56) References Cited

U.S. PATENT DOCUMENTS

| | | | | |
|---|---|---|---|---|
| 3,897,973 | A | 8/1975 | Long et al. | |
| 5,352,020 | A * | 10/1994 | Wade et al. | 297/423.26 |
| 6,095,610 | A * | 8/2000 | Okajima et al. | 297/423.36 |
| 6,526,643 | B1 * | 3/2003 | Renault | 297/423.26 X |
| 6,652,033 | B2 * | 11/2003 | Satoh | 297/423.3 |
| 6,663,184 | B2 * | 12/2003 | Hagiike | 297/423.3 |
| 6,929,323 | B2 * | 8/2005 | Enno | 297/423.26 X |

FOREIGN PATENT DOCUMENTS

| | | |
|---|---|---|
| DE | 94 18 730 | 4/1996 |
| EP | 680 713 | 11/1995 |
| EP | 1 066 776 | 1/2001 |
| EP | 1 333 940 | 9/2001 |
| FR | 70 569 | 5/1959 |
| GB | 847 170 | 9/1960 |

* cited by examiner

*Primary Examiner*—Rodney B. White
(74) *Attorney, Agent, or Firm*—Sughrue Mion Pllc.

(57) ABSTRACT

Mechanism for simultaneously turning up and stretching out an extension part (12,112) relative to a reference part (1,101),with a telescopic sliding profile element (10,110) connected to the reference part and to the extension part, The essentially fixed sliding profile element may be connected to said reference part via a pantograph framework The invention also relates to recliner chair constructions involving such mechanism for turning up and simultaneously stretching out a footrest.

15 Claims, 8 Drawing Sheets

RECLINER CHAIR HAVING A TURNING UP AND STRETCHING OUT FOOTREST MECHANISM

BACKGROUND OF THE INVENTION

The invention relates to a mechanism allowing an extension part to simultaneously turn out (turn up) and stretch out (extend) relative to an object into which or against which it rests in turned back (turned in, turned down) position.

Such mechanisms find in particular their application in recliner chairs with a footrest which simultaneously turns up and stretches out.

The mechanisms currently known for turning up and simultaneously stretching out a footrest of a seating furniture (like in particular in certain, so called "recliner chairs" or "relaxation chairs") involve a rather complicated construction, using trapeze lever systems and/or lever and cable systems.

Such systems have shown in practice to be insufficiently safe, and furthermore too expensive and too heavy, too bulky and/or insufficiently reliable.

A specific system thus proposed for achieving the simultaneous pivoting and sliding movement of the footrest, involves the general principle of

- fixed, linearly extending means, having one end connected with a reference part and the other end pivotally connected with an extension part, and
- hinging, linearly extending means, having one end pivotally connected with a swivel point on the reference part and the other end rigidly connected with the extension part and pivotally connected with the other end of the fixed, linearly extending means.

Such a specific system is for instance known from EP 1 122 940, which discloses an extensible footrest mechanism for armchairs, sofas and the like, involving a frame, hinged to the frame of a seat or armchair, with the footrest provided on said hinged frame via slideable arms; the linearly extending stem of an actuator, rigidly connected to the seat frame, acts upon the slideably supported footrest via a pivot connection, so that extension of the actuator provokes the simultaneous pivoting and sliding movement of the footrest.

The known devices operating according to this general principle however have drawbacks in respect of cost, weight, reliability and operating smoothness.

SUMMARY OF THE INVENTION

The object of this invention is to provide an improved I simplified mechanism for turning out (or, equivalently, turning up) and stretching out (extending) an extension part, and to apply such mechanism in chair constructions with a turning up and stretching out (extending) footrest.

The invention therefor provides a mechanism for simultaneously turning up and stretching out an extension part relative to a reference part, comprising at least one "essentially fixed", linearly extending means having one end interconnected with said reference part and the other end pivotally interconnected with said extension part, and at least one hinging, linearly extending means, having one end pivotally connected with a swivel point on said reference part and the other end, which is rigidly interconnected with said extension part, pivotally interconnected with said other end of said essentially fixed, linearly extending means, whereas said essentially fixed, linearly extending means and said hinging, linearly extending means are each composed of telescopic sliding profile elements, the essentially fixed sliding profile element(s) having a first profile interconnected with said reference part and the other profile pivotally interconnected with said extension part, and the hinging sliding profile element(s) having a first profile pivotally connected to a swivel point on said reference part, and the other profile, which is rigidly interconnected with said extension part, pivotally interconnected with said (corresponding) other profile of the essentially fixed sliding profile element.

The expression "essentially fixed" as used in the present text with respect of a first type of linearly extending means, respectively sliding profile element(s), has a relative meaning, as in contrast with the other type, namely the hinging linearly extending means, respectively sliding profile element(s); the expression means that the first type of linearly extending means, respectively sliding profile element(s) is not necessarily totally rigidly fixed to the reference part, but may also, for certain embodiments, involve a connection with the reference part which allows some minor pivoting and/or translation movements with respect to the reference part, in order to provide for an even smoother operation of the mechanism. Whereas the pivoting of the hinging linearly extending means, respectively sliding profile element(s), involves a maximum angular movement of more than 90°, the minor pivoting and/or translation movements of the "essentially fixed" linearly extending means, respectively sliding profile element(s), involve not more than a few degrees of pivoting and/or a few centimeters of translation.

According to preferred feature of the invention, the first profiles and the other profiles of the essentially fixed sliding profile element(s) and the hinging sliding profile element(s) are interconnected with each other and with said reference part so that said hinging sliding profile element hinges in a plane parallel to the sliding movement of said essentially fixed sliding profile element and said hinging sliding profile element.

According to a preferred embodiment of the invention, the mechanism may in particular comprise two sets of essentially fixed telescopic sliding profile elements and two sets of hinging telescopic sliding profile elements, positioned symmetrically with respect to the reference part and/or the turning up and stretching out extension part. One mechanism thus involves two "pairs" of standard sliding profile elements, one pair for the essentially fixed, linearly extending means and one pair for the hinging, linearly extending means.

According to another preferred embodiment of the invention, said "other profile(s)" of the hinging sliding profile element(s) may very suitably act as a support for the extension part.

A further essential feature of the invention involves that, for preferred embodiments, the first profile of the essentially fixed sliding profile element(s) is interconnected to the reference part via a pantograph framework which modifies the direction of the essentially fixed sliding profile element in function of the hinging of the hinging sliding profile element.

In particular the pantograph framework may most appropriately involve a swivel point connection between said first profile of the essentially fixed sliding profile element and said reference part, a swivel point connection between said first profile of the hinging sliding profile and a pantograph framework main part, a swivel point connection between said first profile of the hinging sliding profile and the reference part, a lever connection between said first profile of said essentially fixed sliding profile element and said pantograph framework main part, ), via two further swivel points, and a lever connection between said pantograph framework main part and said reference part.

According to another preferred feature, the sliding profile elements may in particular involve ball bearing elements.

The invention furthermore provides a recliner seat/chair construction comprising a footrest which simultaneously turns up and stretches out, relative to the "chair", involving a mechanism as set forth here above, in which said extension part of the mechanism constitutes the turning up and stretching out footrest.

The expression "relative to the chair" as used in the present text with respect to the turning up and stretching out movement of the footrest, has a relative meaning and refers to the overall position of the chair (embodied in the chair itself or the chair seat or the chair support or base frame).

According to preferred features of the relaxation chair construction of the invention, it may in particular comprise at least one "essentially fixed", linearly extending means having one end interconnected with the chair and the other end pivotally interconnected with said footrest, and at least one hinging, linearly extending means, having one end pivotally connected to a swivel point on the chair, and the other end, which is rigidly interconnected with the footrest, pivotally interconnected with said other end of said essentially fixed, linearly extending means, whereas the essentially fixed, linearly extending means and the hinging, linearly extending means are each composed of telescopic sliding profile elements, the essentially fixed sliding profile element(s) having a first profile interconnected with the chair and the other profile pivotally interconnected with the footrest, and the hinging sliding profile element(s) having a first profile pivotally connected to a swivel point on the chair, and the other profile, which is rigidly interconnected with the footrest, pivotally interconnected with said (corresponding) other profile of the essentially fixed sliding profile element.

According to preferred feature of the chair construction of the invention the first profiles and the other profiles of the essentially fixed sliding profile element(s) and the hinging sliding profile element(s) are interconnected with each other and with the chair so that said hinging sliding profile element hinges in a plane parallel to the sliding movement of said essentially fixed sliding profile element and said hinging sliding profile element.

According to a preferred embodiment of the invention, the chair construction may in particular comprise two sets of essentially fixed telescopic sliding profile elements and two sets of hinging telescopic sliding profile elements, positioned symmetrically with respect to the chair and/or the turning up and stretching out footrest.

According to another preferred embodiment of the invention said other profile(s) of said hinging sliding profile element(s) acts/act as support for said footrest.

A further essential feature of the invention involves that, for preferred embodiments of the chair construction, the first profile of the essentially fixed sliding profile element(s) is interconnected to the chair via a pantograph framework which modifies the direction of the essentially fixed sliding profile element in function of the hinging of the hinging sliding profile element.

A particularly preferred chair construction involves a pantograph framework with a swivel point connection between said first profile of the essentially fixed sliding profile element and the chair, a swivel point connection between said first profile of the hinging sliding profile and a pantograph framework main part, a swivel point connection between said first profile of the hinging sliding profile and the reference part, a lever connection between said first profile of said essentially fixed sliding profile element and said pantograph framework main part, via swivel point (24) and (25), and a lever connection between said pantograph framework main part and the chair.

Most suitably the chair construction may use sliding profile elements which slide on ball bearing elements.

The new relaxation chair construction/mechanism according to the invention offers numerous advantages over the state of the art constructions/mechanisms:

the mechanism avoids the "scissor effect" and thus involves optimal safety;

the mechanism is simple, cheap, strong and nevertheless light;

it operates very lightly and smoothly, with the consequence that, just by properly choosing the centre of gravity and/or the proportions of the seat and footrest, one may very simply obtain a footrest movement which results only from the weight of the user, with a return to retracted position by very simple means;

as a further consequence the backrest of the seat may, at will, be connected to the mechanism for turning up and stretching out the footrest, or be provided totally independent of said mechanism.

BRIEF DESCRIPTION OF THE DRAWINGS

Further features and details of the invention will become apparent from the following description of specific embodiments of mechanisms and chair constructions according to the invention, set forth by way of examples having reference to the attached drawings.

In these drawings.

DETAILED DESCRIPTION OF THE INVENTION

It should be stressed that the details and particularities of the embodiments of the examples do not imply any limitation to the scope of the invention. Numerous modifications and alternatives to these details and particularities will readily be understood by those skilled in the art without departing from the general scope of the invention as set forth in the disclosure here above and as defined in the attached claims.

Figure 1:
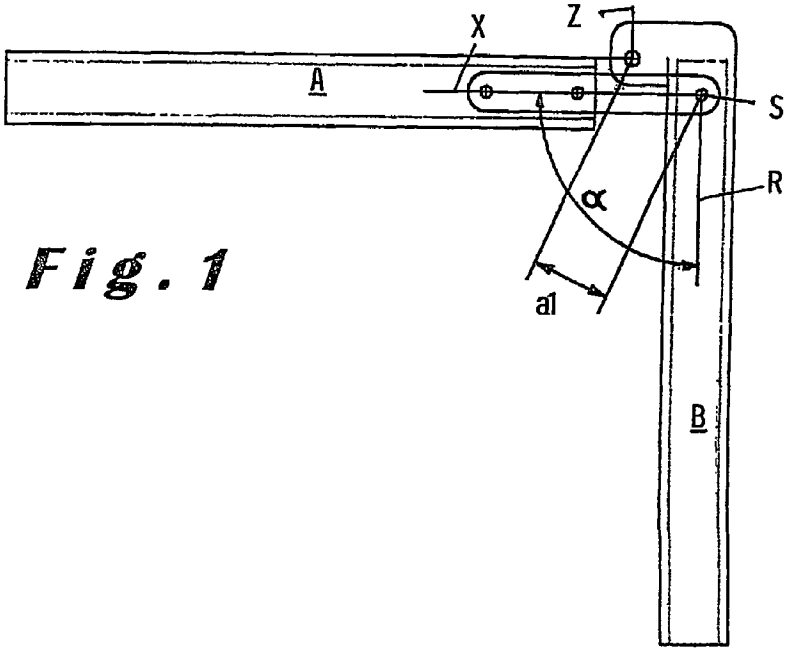
FIG. 1 represents a schematic lateral view of a mechanism according to the invention, for turning up and stretching out an extension part, in turned down and retracted position.
Figure 2:
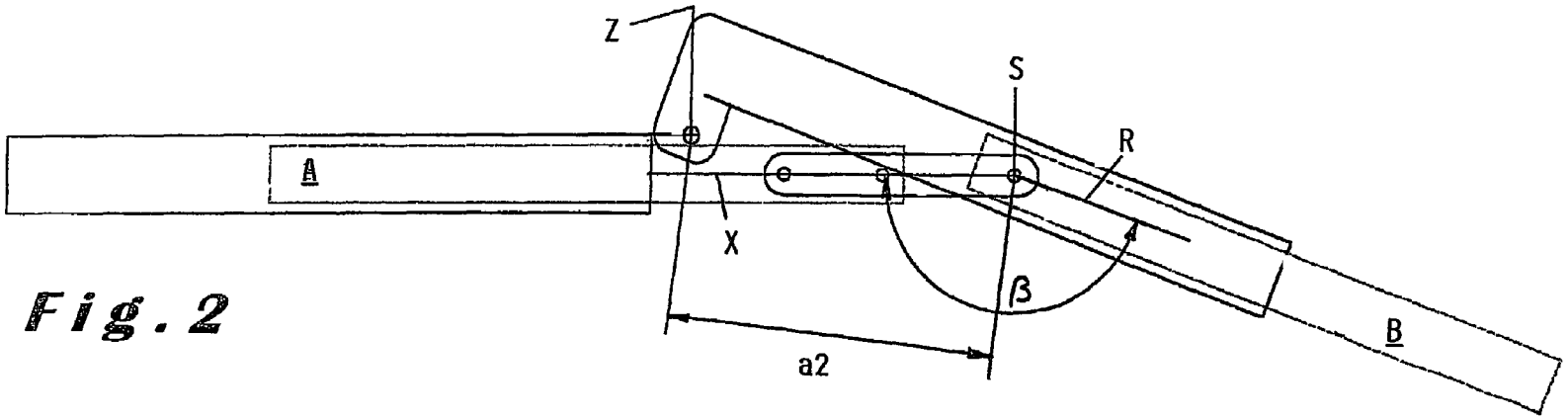
FIG. 2 represents a schematic lateral view of the mechanism of FIG. 1 in turned up and extended position.

FIG. 1 and 2 schematically show a mechanism according to the invention, for simultaneously turning up and stretching out an extension part. The mechanism comprises one "essentially fixed", linearly extending means (telescopic sliding profile element) with a telescopically sliding profile A, and one hinging linearly extending means (telescopic sliding profile element) with a telescopically sliding profile B.

The hinging telescopic sliding profile element is connected in a hinging manner, through its first ("fixed") profile, via a swivel point Z, with the first ("fixed") profile of the "essentially fixed" telescopic sliding profile.

The sliding profile A of the "essentially fixed" telescopic sliding profile element and the sliding profile B of the hinging telescopic sliding profile element are connected in an hinging manner via swivel point S.

The sliding profile A of the "essentially fixed" telescopic sliding profile element moves along a line X, whereas the sliding profile B of the hinging telescopic sliding profile element moves along the rotating line R.

In FIG. 1 the hinging sliding profile element is shown in turned down position (with retracted sliding profile B), with an angle a between line X and line R, whereas in FIG. 2 the hinging sliding profile element is shown in turned up position (with extended sliding profile B), with an angle β between line X and line R.

Between the turned down position (FIG. 1) and the turned up position (FIG. 2) the distance "a" between the swivel points Z and S changes from the smallest distance $a_1$ to the largest distance $a_2$.

Figure 3:
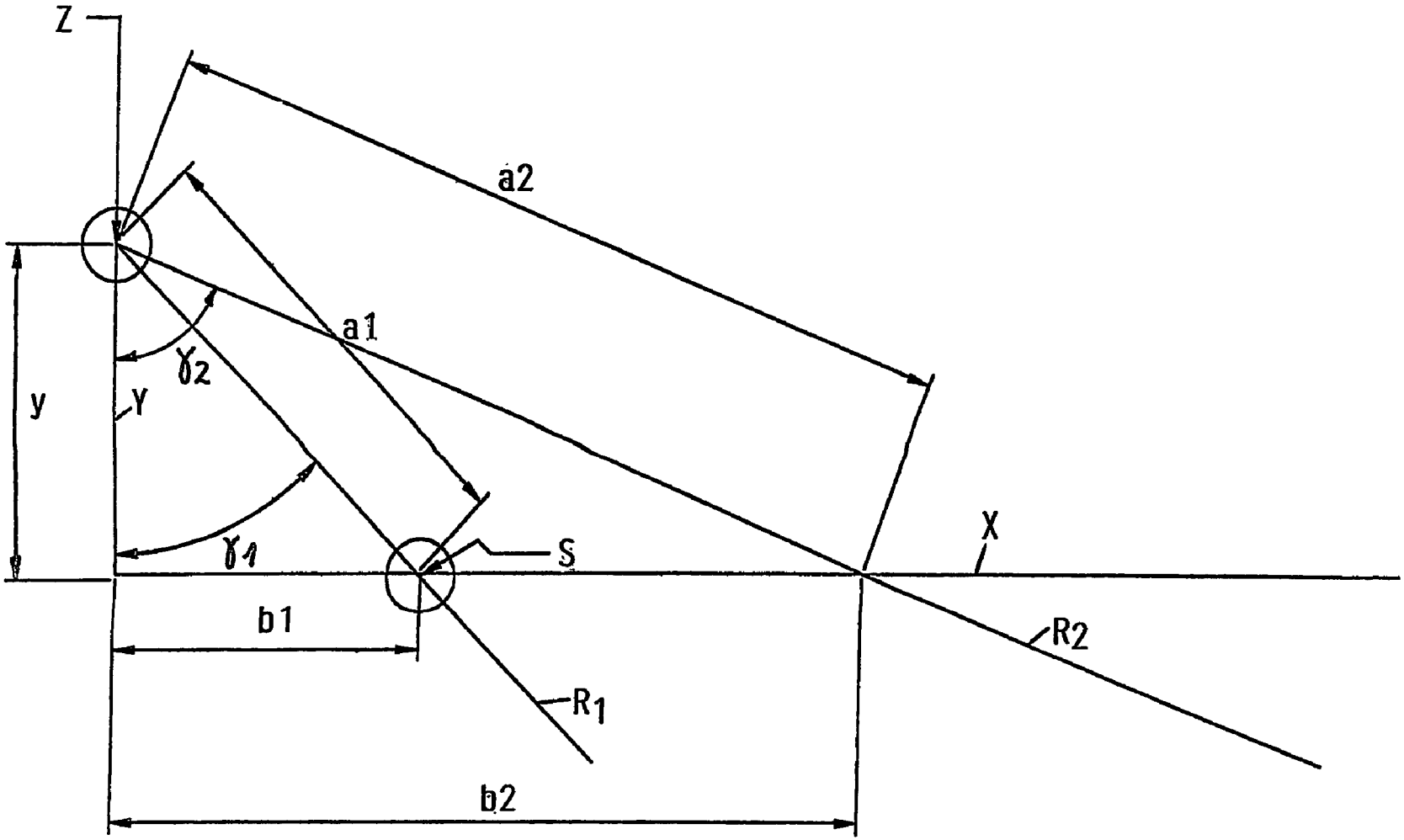
FIG. 3 represents a schematic illustration of the principle of the mechanism according to the invention.

The operating principle of the turning up and stretching out mechanism according to the invention is illustrated by FIG. 3.

This figure shows schematically the fixed line X of the "essentially fixed" telescopic sliding profile element with thereon swivel point S, connecting the sliding profile parts with each other; the drawing also shows the "fixed" swivel point Z of the hinging telescopic sliding profile element relative to the "essentially fixed" telescopic sliding profile element.

The perpendicular distance between the swivel point Z and the fixed line X, according to line Y is designated as section y.

The section y, the (fixed) swivel point Z and the (variable) swivel point S form a right-angled triangle; the perpendicular (adjacent) side y of this right-angled triangle has a fixed length, whereas the opposite side and the hypotenuse side change in length as the swivel point S moves when the profile A extends along line X and the hinging sliding element turns up with profile B from line $R_1$ to line $R_2$, whereas the angle between the adjacent side y and the hypotenuse side increases from $y_1$ to $y_2$.

At the same time the opposite side increases from a length $b_1$ to a length $b_2$, and the hypotenuse side increases from a length $a_1$ to a length $a_2$.

Figure 4:
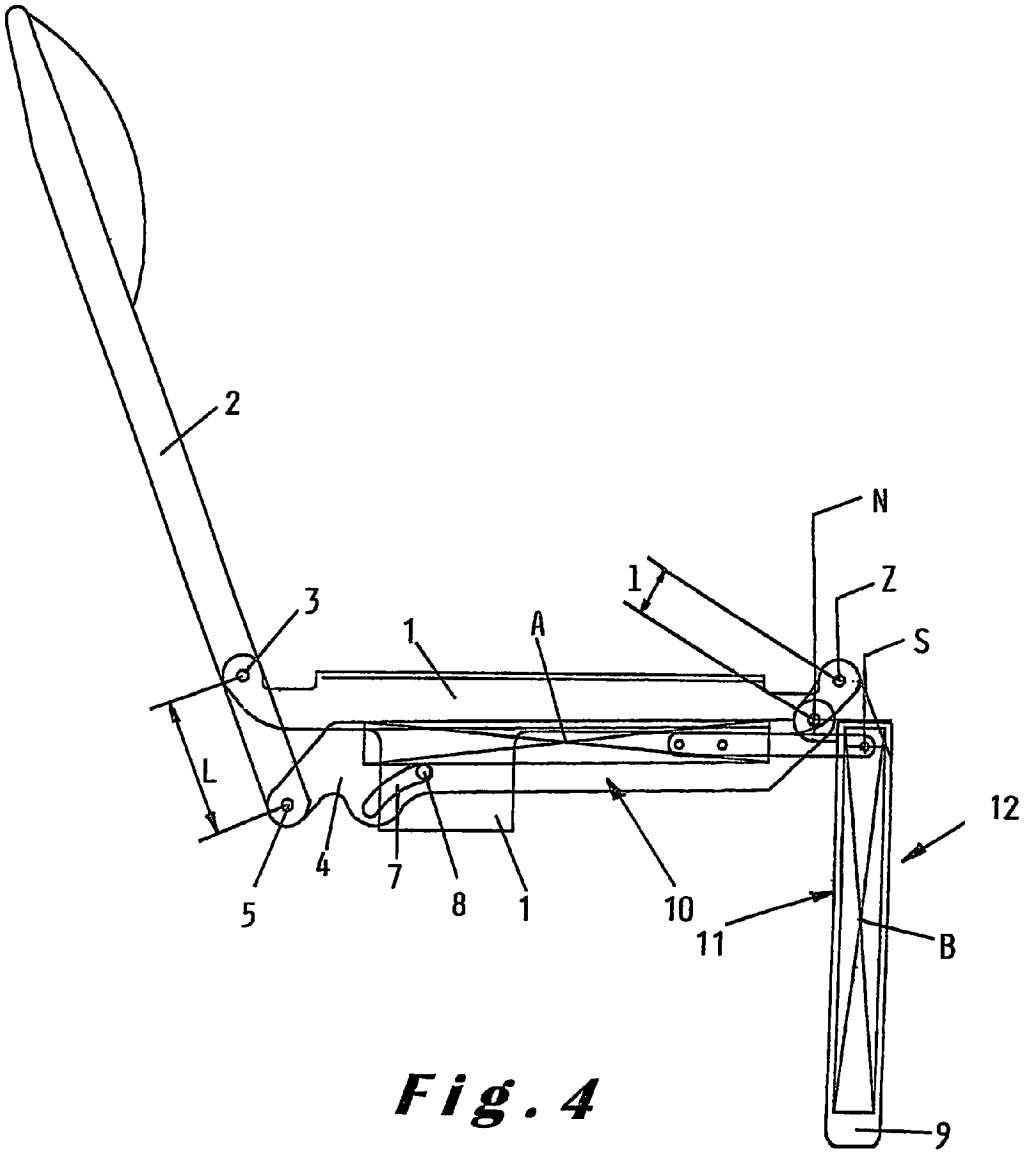
FIGS. 4-6 represent a schematic lateral view of a first embodiment of a seat or chair construction according to the invention, respectively in a position with turned down and retracted footrest, in an intermediate position, in a position with turned up and extended footrest
Figure 5:
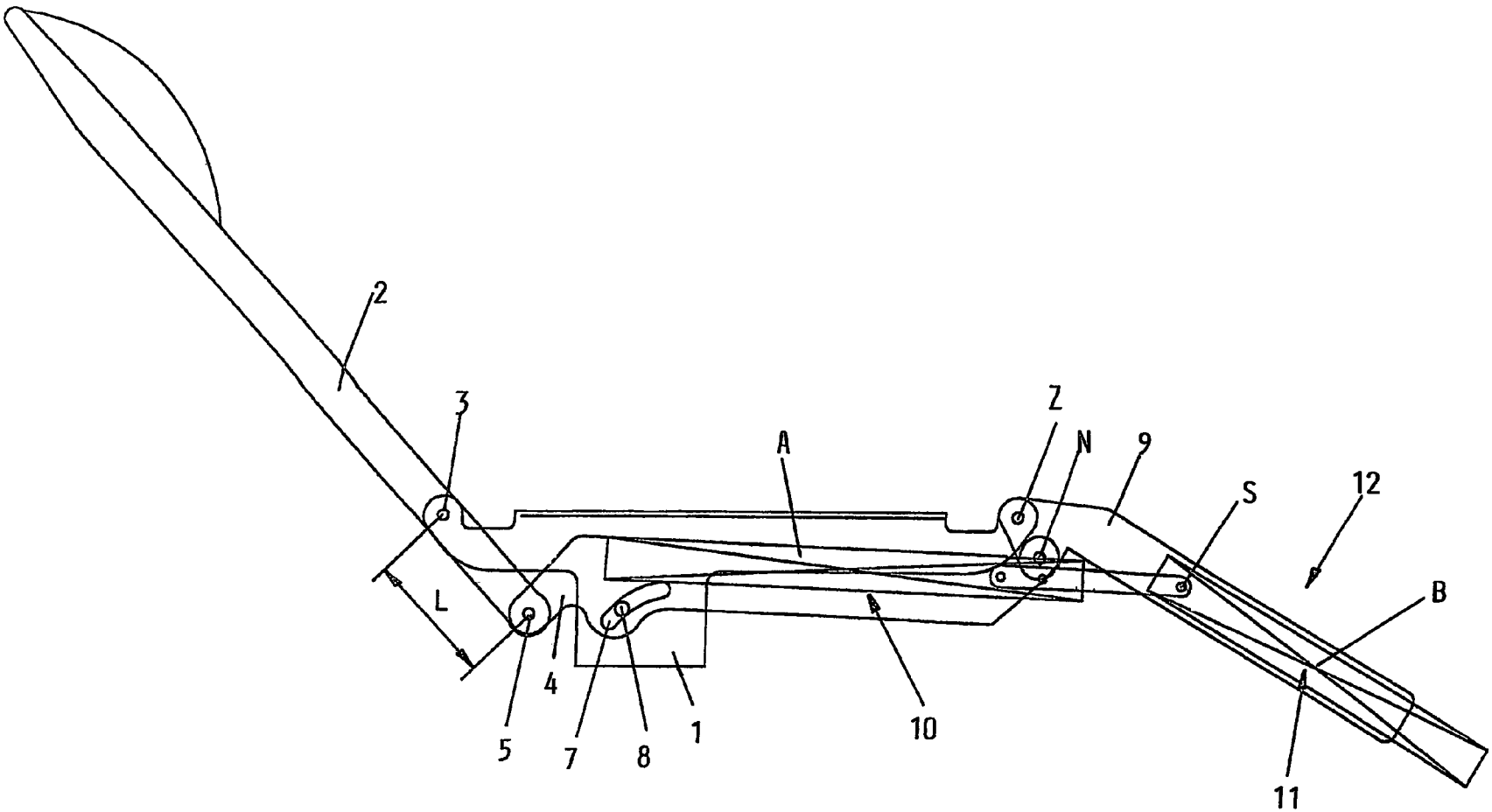
Figure 6:
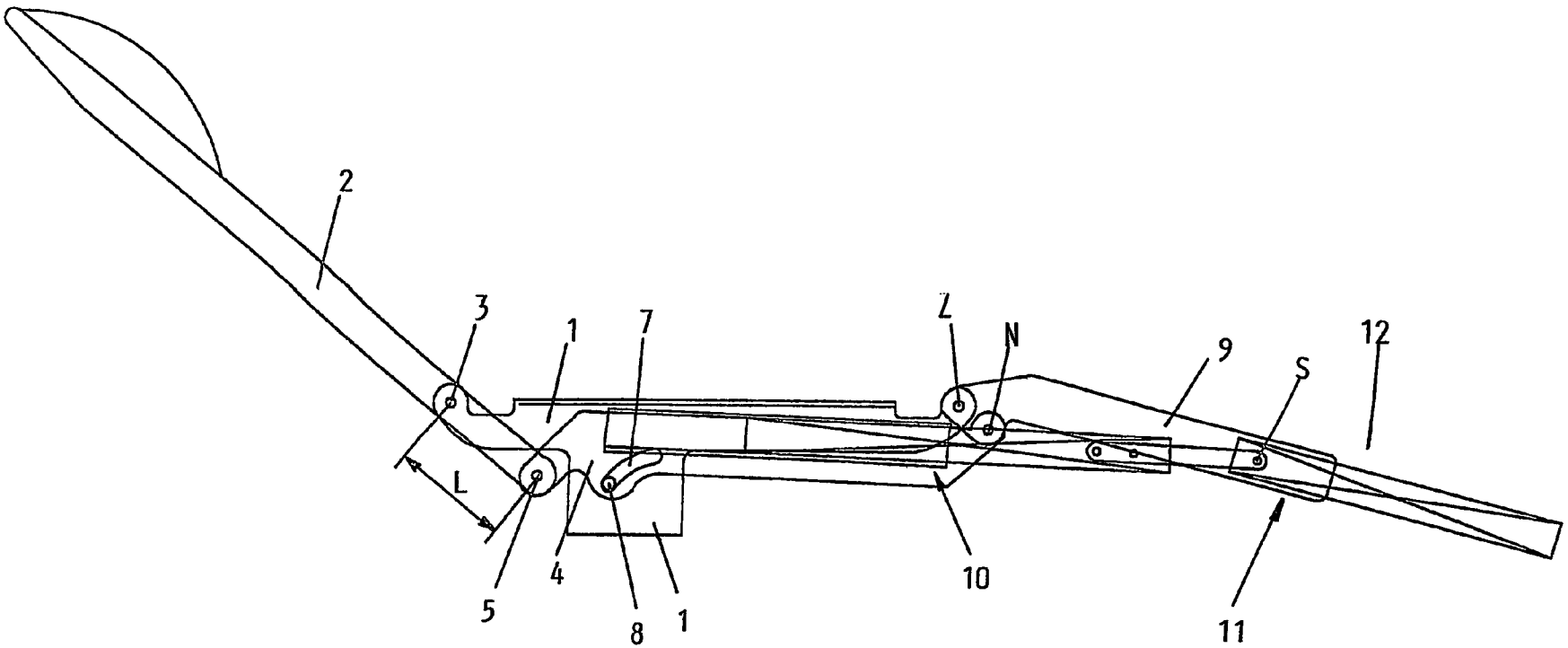

FIGS. 4-6 illustrate the application of the mechanism according to the invention in a first embodiment of a recliner chair construction comprising a footrest which simultaneously turns up and extends relative to the chair. The chair construction comprises on both sides (in the figures only the left side is visible) a mounting plate I for providing the seat (not represented) and for mounting the construction on a chair support or feet (not represented)

The construction shown in

FIGS. 4-6 relates to an embodiment with a backrest 2 which participates in the operation of the mechanism.

The backrest 2 is pivotally connected with mounting plate 1, via swivel point 3. At its lower end the backrest 2 is furthermore pivotally connected with a movable plate 4, via a swivel point 5. The movable plate 4 comprises a slit 7 which cooperates with a pin 8 on mounting plate 1, so as to provide a braking effect on the movement of the mechanism.

A further swivel arm 9 is provided to the mounting plate 1, hinging around swivel point Z on the extremity of the mounting plate 1 which is most remote from point 3.

The swivel arm 9 is pivotally connected, via swivel point N, with the extremity of the movable plate 4 which is most remote from point 5. The "essentially fixed" sliding profile element, designated as a whole by reference numeral 10, is attached to the moving plate 4, and the hinging sliding profile element, designated as a whole by reference numeral 11, is attached to the swivel arm 9, whereas the adjacent ends of sliding profile parts A and B of the sliding profile elements 10 and 11 are pivotally connected with each other via swivel point S.

It goes without saying that the swivel points Z, N and S should not lie on one line. For an optimal functioning of the mechanism the ratio of the distance "L" between swivel points 3 and 5 to the distance "I" between swivel points Z and N should preferably lie between 2:1 and 4:1, and most preferably take the value of approximately 3:1 as shown in the drawing.

The footrest 12 of the recliner chair construction is connected to the sliding profile parts B on both sides of the chair construction (only the left side is visible in the figures).

A comparison of FIGS. 4-6 with the successive positions of the seat mechanism according to the invention, clearly illustrates how a force exerted on the backrest 2 of the chair will cause the footrest 12 to turn up and stretch out, whereas the stretching out occurs essentially in a straight line as the pivoting movement around swivel points 3 and Z in converted to a straight line movement, as a result of the principle explained above, of the triangle with one fixed side and one side which extends along a straight line.

As indicated, the use of slit 7 cooperating with pin 8 is mainly to provide a braking effect on the movement of the mechanism and to help maintaining the mechanism in intermediate positions.

The backward movement of the footrest to its pulled in and retracted position is facilitated by exerting some force with the feet on the footrest. This feature constitutes a further interesting advantage of the mechanism according to the invention.

Figure 7:
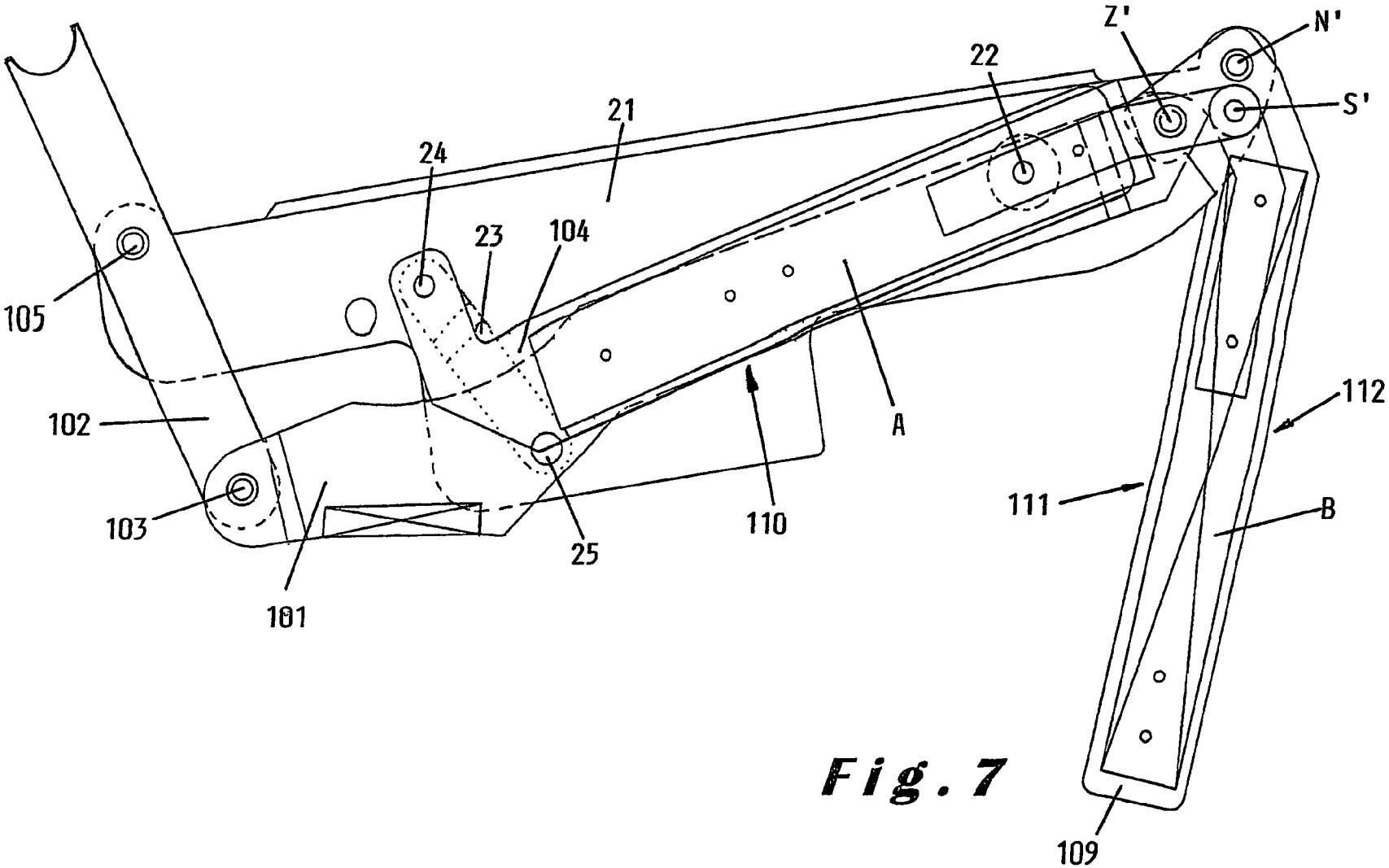
FIGS. 7-9 represent a schematic lateral view of another embodiment of a seat or chair construction according to the invention, respectively in a position with turned down and retracted footrest, in an intermediate position, in a position with turned up and extended footrest
Figure 8:
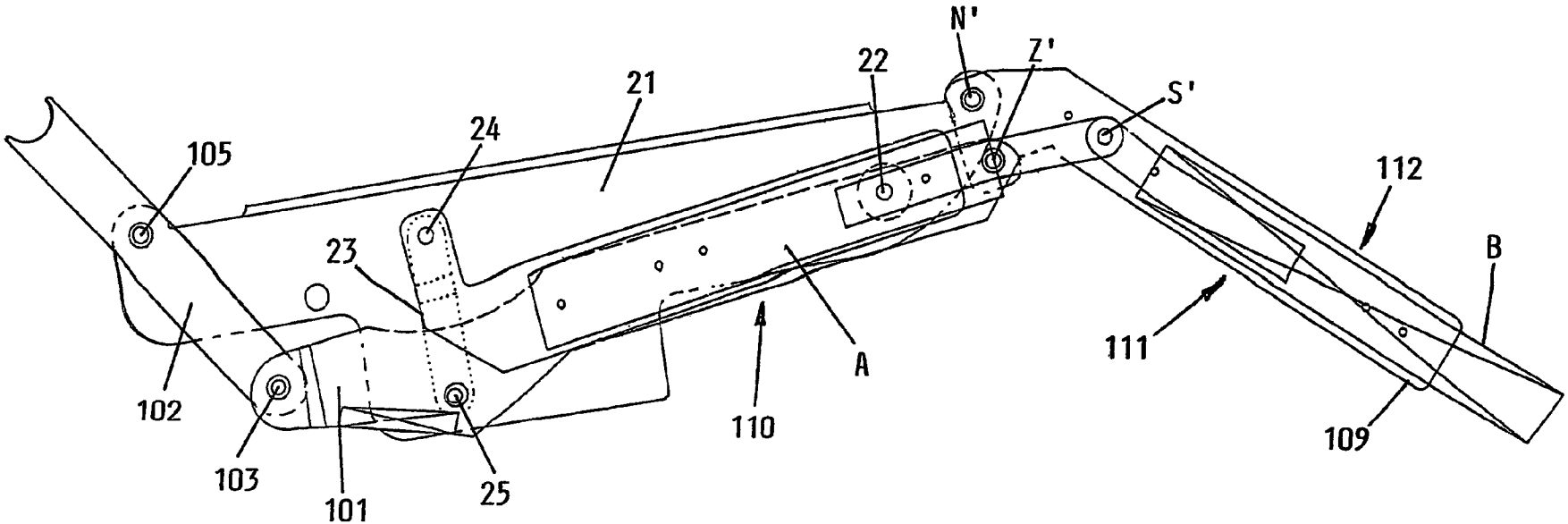
Figure 9:
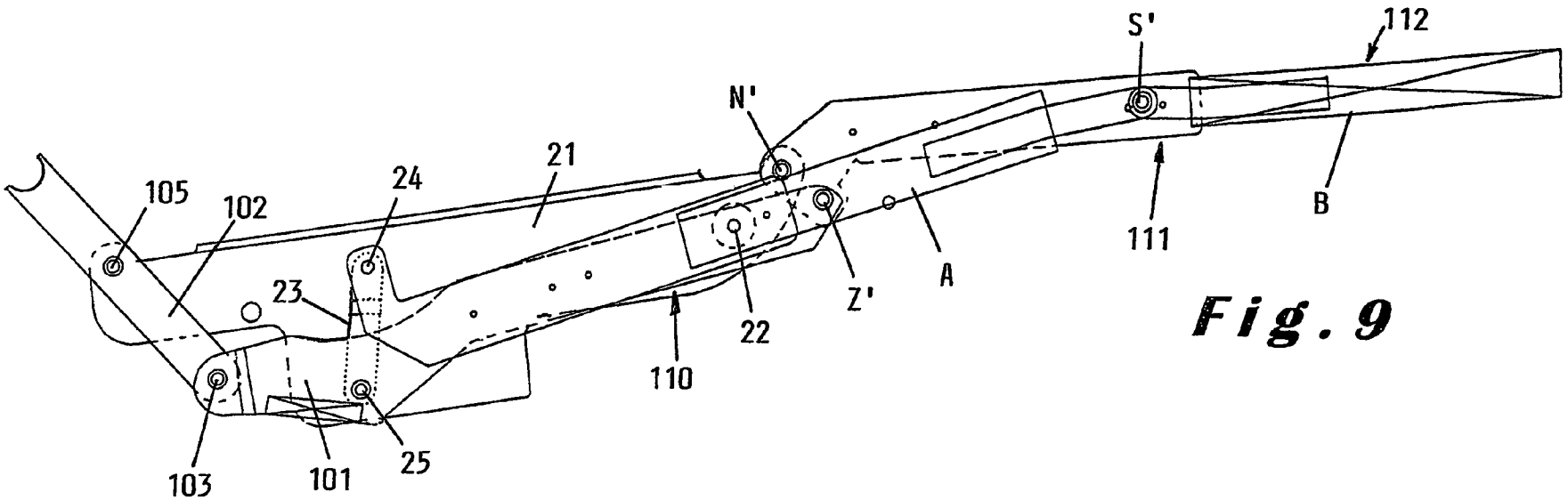

FIGS. 7-9 illustrate the application of the mechanism according to the invention in another embodiment of a recliner chair construction comprising a footrest which simultaneously turns up out and extends relative to the chair.

The chair construction comprises on both sides (in the figures only the left side is visible) a mounting plate 101 for providing the seat (not represented) and for mounting the construction on a chair support or feet (not represented), and a swivelling footrest support arm 109.

The construction shown in FIGS. 7-9 relates to an embodiment wherein the backrest does not participate in the operation of the mechanism.

The mechanism for turning up and stretching out the footrest 112 rather involves a pantograph framework comprising:

a movable plate 104, a pantograph framework main part 21, a swivel point connection 22 between the movable plate 104 and the mounting plate 101, a swivel point connection N' between the footrest support and 109 and the pantograph framework part 21, a swivel point connection Z' between the footrest support arm 109 and the mounting plate 101, a lever connection 23 connecting the movable plate 104 and the pantograph framework part 21, respectively via swivel points 25 and 24, a lever connection 102 connecting the mounting plate 101 and the pantograph framework part 21, respectively via swivel points 103 and 105.

The swivel arm 109 is pivotally connected to the mounting plate 101, via swivel point Z' located on the extremity of mounting plate 101 which is most remote from point 103.

The swivel arm 109 is also pivotally connected to the movable plate 104, via swivel point N' located on the extremity of the movable plate 104 which is most remote from point 105.

The lever 102 interconnects the mounting plate 101 to the movable plate 104, via swivel points 103 and 105.

The "essentially fixed" sliding profile element, designated as a whole by reference numeral 110, is attached to the movable plate 104, and the hinging sliding profile element, designated as a whole by reference numeral 111, is attached to the swivel arm 109, whereas the adjacent ends of sliding profile parts A and B of the sliding profile elements 110 and 111 are pivotally connected with each other via swivel point S'.

It goes without saying that the swivel points Z, N and S should not lie on one line.

For an optimal functioning of the mechanism the ratio of the distance between swivel points 103 and 105 to the distance between swivel points Z' and N' should preferably lie between 2:1 and 4:1, and most preferably take the value of approximately 3:1.

The footrest 112 of the recliner chair construction of FIGS. 7-9 is connected to the sliding profile parts B on both sides of the chair construction (only the left side is visible in the figures).

A comparison of FIGS. 7-9 with the successive positions of the seat mechanism according to the invention, clearly illustrates how a force exerted on the pantograph framework main part 21, acting as support for the seat of the chair, will cause the footrest 112 to turn up and stretch out, whereas the stretching out occurs essentially in a straight line as the pivoting movement around swivel points 103 and Z in converted to a straight line movement, as a result of the principle explained above, of the triangle with one fixed side and one side which extends along a straight line.

The pantograph framework system according to this embodiment of the invention provides the possibility for letting go the footrest much higher in its turning up and stretching out movement.

The system also allows a much easier operation of the mechanism, merely by the weight of the user on the seat or on the footrest. This avoids the drawback of having to involve the backrest of the chair for operating the mechanism, which constitutes a very interesting advantage of the mechanism according this embodiment of the invention.

The invention claimed is:

1. Mechanism for simultaneously turning up and stretching out an extension part (12,112) relative to a reference part (1,101), comprising at least one first, linearly extending telescopic sliding profile element (10,110), having a first profile part rigidly interconnected with said reference part and a second profile part (A) pivotally interconnected with said extension part via a first swivel point (S,S'), and at least one hinging second, linearly extending telescopic sliding profile element, having a first profile part pivotally connected to a second swivel point (Z,Z'), on said reference part, and a second profile part (B) rigidly interconnected with said extension part, and pivotally interconnected with said second profile part of said first, linearly extending profile element, via said first swivel point, wherein the first linearly extending profile element moves in only minor pivoting and translational movements, which are smaller than those of said at least one hinging second linearly extending profile element, to provide smooth operation of said mechanism.

2. Mechanism according to claim 1, wherein said first profile parts and said second profile parts of said at least one first sliding profile element and said at least one hinging second sliding profile elements, respectively, are interconnected with each other and with said reference part so that said hinging second sliding profile element hinges in a plane parallel to sliding movements of said first sliding profile element and said hinging second sliding profile element.

3. Mechanism according to claim 1, comprising two sets of first telescopic sliding profile elements and two sets of hinging second telescopic sliding profile elements, positioned symmetrically with respect to said reference part and/or said turning up and stretching out extension part.

4. Mechanism according to claim 1, wherein said second profile part of said at least one hinging second sliding profile element acts as support for said extension part.

5. Mechanism according to claim 1, wherein said first profile part of said at least one first sliding profile element is interconnected to said reference part via a pantograph framework which modifies the direction of said first sliding profile element in function of the hinging of said hinging second sliding profile element.

6. Mechanism according to claim 5, wherein said pantograph framework comprises:

a swivel point connection between said first profile part of said first sliding profile element and said reference part, a swivel point connection between said first profile part of said hinging second sliding profile element and a pantograph framework main part, a swivel point connection between said first profile part of said hinging second sliding profile element and said reference part, a lever connection between said first profile part of said first sliding profile element and said pantograph framework main part, via swivel points, and a lever connection between said pantograph framework main part and said reference part.

7. Mechanism according to claim 1, wherein said sliding profile elements slide on ball bearing elements.

8. Recliner chair construction comprising a footrest which simultaneously turns up and stretches out relative to said chair or a chair support part comprising a mechanism according to claim 1, in which said extension part of said mechanisms constitutes said turning up and stretching out footrest.

9. Recliner chair construction comprising a footrest (12, 112) which simultaneously turns up and stretches out relative to said chair (1,101), comprising at least one first, linearly extending a telescopic sliding profile element (10,110), having a first profile part rigidly interconnected with said chair or a chair support part and a second profile part (A) pivotally interconnected with said footrest via a first swivel point (S,S'), and at least one hinging, second linearly extending telescopic sliding profile element, having a first profile part pivotally connected to a second swivel point (Z,Z'), on the chair, and a second profile part rigidly interconnected with said footrest and pivotally interconnected with said second profile part of said first, linearly extending profile element, via said first swivel point, wherein the first linearly extending profile element means moves in only minor pivoting and translation movements, which are smaller than those of said at least one hinging second linearly extending profile element, to provide smooth operation of said mechanism.

10. Chair construction according to claim 9, wherein said first profile parts and said second profile parts of said at least one first sliding profile element and said at least one hinging second sliding profile element are interconnected with each other and with the chair so that said hinging second sliding profile element hinges in a plane parallel to sliding movements of said first sliding profile element and said hinging second sliding profile element.

11. Chair construction according to claim 9, comprising two sets of first telescopic sliding profile elements and two sets of hinging second telescopic sliding profile elements, positioned symmetrically with respect to the chair and/or the turning up and stretching out footrest.

12. Chair construction according to claim 9, wherein said second profile part of said at least one hinging second sliding profile element acts as support for said footrest.

13. Chair construction according to claim 9, wherein said first profile part of said at least one first sliding profile element is interconnected to said chair via a pantograph framework which modifies the direction of said first sliding profile element in function of said hinging of the hinging second sliding profile element.

14. Chair construction according to claim 13, wherein said pantograph framework comprises:

a swivel point connection between said first profile part of the first sliding profile element and a chair frame, a swivel point connection between said first profile part of the hinging second sliding profile and a pantograph framework main part, said second swivel point connection between said first profile part of the hinging second sliding profile element and said footrest, a lever connection between said first profile part of said first sliding profile element and said pantograph framework main part, via further swivel points, and a lever connection between said pantograph framework main part and the chair frame.

15. Chair construction to claim 1, wherein said sliding profile elements slide on ball bearing elements.

* * * * *

UNITED STATES PATENT AND TRADEMARK OFFICE

CERTIFICATE OF CORRECTION

PATENT NO. : 7,273,257 B2
APPLICATION NO. : 10/531046
DATED : September 25, 2007
INVENTOR(S) : Koen De Vroe It is certified that error appears in the above-identified patent and that said Letters Patent is hereby corrected as shown below:

On the title page (73), correct the Assignee information to read as follows:
--N. V. De Vroe, Zottegem (BE); Alfor SPRL, Brussels (BE)--.

Signed and Sealed this

Twenty-ninth Day of April, 2008

JON W. DUDAS
*Director of the United States Patent and Trademark Office*